United States Patent [19]

Osika et al.

[11] Patent Number: 4,947,009

[45] Date of Patent: Aug. 7, 1990

[54] CONSCIOUS EFFORT SAFETY SWITCH

[75] Inventors: Thomas F. Osika, Valparaiso; John A. Stuhlmacher, Crown Point, both of Ind.

[73] Assignee: McGill Manufacturing Company, Inc., Valparaiso, Ind.

[21] Appl. No.: 401,944

[22] Filed: Sep. 1, 1989

Related U.S. Application Data

[63] Continuation-in-part of Ser. No. 308,734, Feb. 9, 1989, which is a continuation-in-part of Ser. No. 114,129, Oct. 28, 1987, Pat. No. 4,870,230.

[51] Int. Cl.[5] ..... H01H 3/20

[52] U.S. Cl. ..... 200/43.16

[58] Field of Search ..... 200/43.16, 43.17, 43.01, 200/321, 322, 339, 433

[56] References Cited

U.S. PATENT DOCUMENTS 4,002,874 1/1977 Brown ..... 200/321

4,121,065 10/1978 Woodard ..... 200/43.01

4,187,420 2/1980 Piber ..... 200/43.16

*Primary Examiner*—Renee S. Luebke

*Attorney, Agent, or Firm*—Leydig, Voit & Mayer

[57] ABSTRACT

A three-position electrical switch includes a rocker-type actuator adapted to be pivoted within a housing in opposite directions from a neutral position to first and second actuated positions in order to close first and second sets of switch contacts. The actuator carries a latch which normally engages the housing to prevent the actuator from being pivoted from its neutral position to either of its switch-closed positions. By manually sliding the latch and then pivoting the actuator, the actuator may be moved to either of its switch-closed positions; the two-step operation requiring a conscious effort and protecting against accidental actuation of the switch. The actuator is frictionally maintained in both of its switch-closed positions but may be returned to its neutral or switch-open position by a simple single motion thereby enabling rapid and easy opening of the switch.

3 Claims, 3 Drawing Sheets

CONSCIOUS EFFORT SAFETY SWITCH

CROSS-REFERENCE TO A RELATED APPLICATION

This application is a continuation-in-part of our copending application Ser. No. 308,734, filed Feb. 9, 1989 which, in turn, is a continuation-in-part of our copending application Ser. No. 114,129, filed Oct. 28, 1987 now U.S. Pat. No. 4,870,230.

BACKGROUND OF THE INVENTION

This invention relates generally to an electrical switch of the type having a pivotally mounted rocker actuator.

More specifically, the invention relates to a three-position switch having an actuator which is supported to pivot in one direction from a centered or neutral position to a first actuated position and in the opposite direction from the neutral position to a second actuated position. Such a switch includes two sets of contacts which are in a first state (e.g., open) as long as the actuator is in its neutral position. The actuator changes the state of one set of contacts when it is pivoted to its first actuated position and changes the state of the other set of contacts when it is pivoted to its second actuated position.

With certain types of appliances such as portable home space heaters, it is desirable to protect the switch against accidental actuation and to require a conscious effort in order to actuate the switch and energize the appliance.

SUMMARY OF THE INVENTION

The general aim of the present invention is to provide a new and improved three-position rocker switch which is of comparatively simple and low cost construction, which effectively guards against accidental actuation and which is releasably maintained in each of its actuated states.

A more detailed object of the invention is to achieve the foregoing by providing a three-position rocker switch which can be actuated only if two separate and distinct motions are applied to the switch actuator.

A further object is to provide a three-position conscious effort rocker switch of the foregoing type which is placed and held in an actuated state when the actuator is pivoted to either of its actuated positions and then is manually released.

Another object is to provide a three-position rocker switch in which the actuator, when being held in either of its actuated positions, can be manually returned to the neutral position with a simple single motion so as to simplify opening of the switch.

These and other objects and advantages of the invention will become more apparent from the following detailed description when taken in conjunction with the accompanying drawings.

DETAILED DESCRIPTION OF THE PREFERRED EMBODIMENTS

Figure 1:
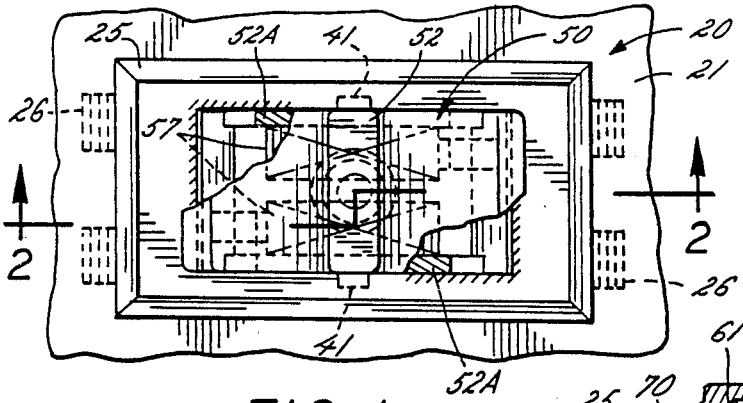
FIG. 1 is a top plan view of one embodiment of a new and improved three-position safety switch incorporating the unique features of the present invention.

For purposes of illustration, the present invention has been shown in the drawings as being incorporated in a three-position electrical switch 20 for making or breaking circuits to one or more electrical utilization devices (not shown). By way of example, the utilization device may be an electrically powered radiant space heater. The switch may be used to turn the heater to a high setting, to turn the heater to a low setting or to turn the heater off.

In the present instance, the switch 20 has been shown in conjunction with a mounting plate 21 which is formed with a rectangular hole 22 for receiving the switch. The switch includes a main body or housing which is defined by a molded plastic cup 24 (FIG. 2) of rectangular cross-section telescoped into the opening 22 and formed with a peripheral flange 25 which engages the upper side of the plate around the margins of the opening. Cantilevered fingers 26 are molded integrally with and are hinged to the cup 24 and are adapted to pass through the opening 22 during insertion of the cup into the opening. Just after such insertion, the fingers 26 spring outwardly and engage the lower portion of the edge of the opening 22 so as to hold the cup 24 in the opening.

Figure 2:
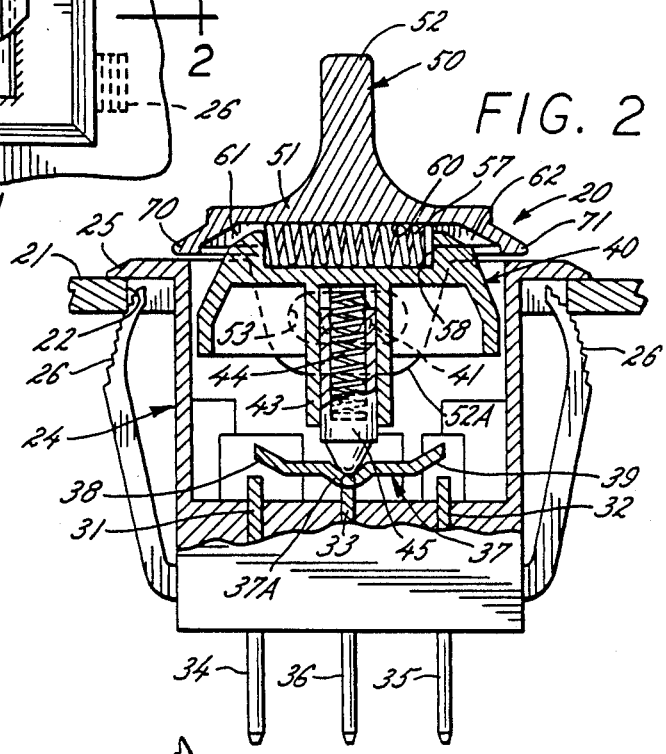
FIG. 2 is a fragmentary cross-section taken substantially along the line 2—2 of FIG. 1.

Located in the bottom of the cup 24 are three spaced switch contacts 31, 32 and 33 (FIG. 2) connected to terminals 34, 35 and 36, respectively. Positioned above the contacts is an electrically conductive contactor arm 37 whose opposite end portions define contacts 38 and 39 which are adapted to engage the contacts 31 and 32, respectively. When the arm 37 is located as shown in FIG. 2, it rests on the contact 33 in a centered or neutral position in which the contacts 38 and 39 are spaced above the contacts 31 and 32 so as to keep the switch 20 in an open state and to keep the appliance de-energized. The center portion of the contact arm 37 is defined by a dimple 37A which is cradled by the center contact 33.

Figure 4:
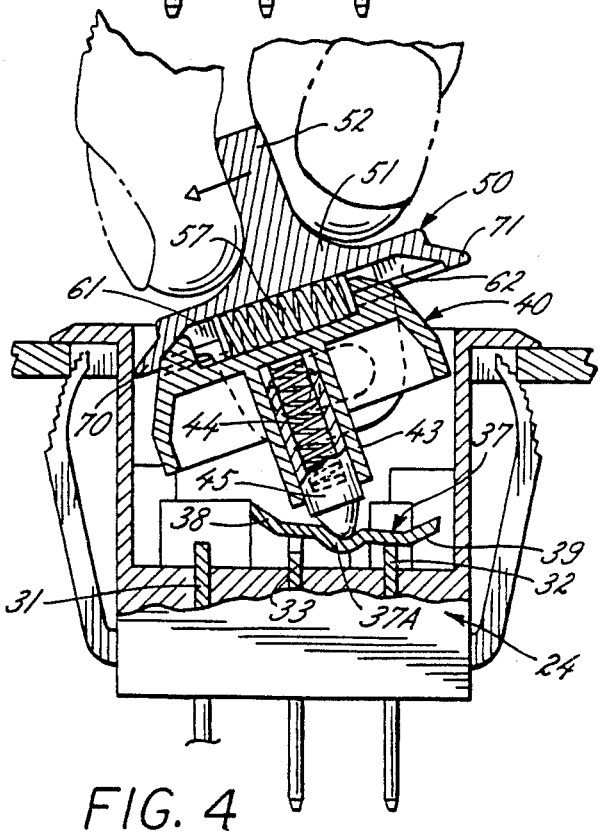

When the contactor arm 37 is slid from left-to-right from the position shown in FIG. 2, it pivots clockwise about the center contact 33 to bring the contact 39 downwardly into engagement with the contact 32, the arm thereby bridging the contacts 32 and 33 as shown in FIG. 4 and completing, for example, the high heat circuit of the heater. Conversely, right-to-left sliding of the contactor arm 37 causes the arm to pivot counterclockwise about the center contact 33 in order to bring the contact 38 into engagement with the contact 31 (see FIG. 6) and energize the low heat circuit of the heater.

Figure 6:
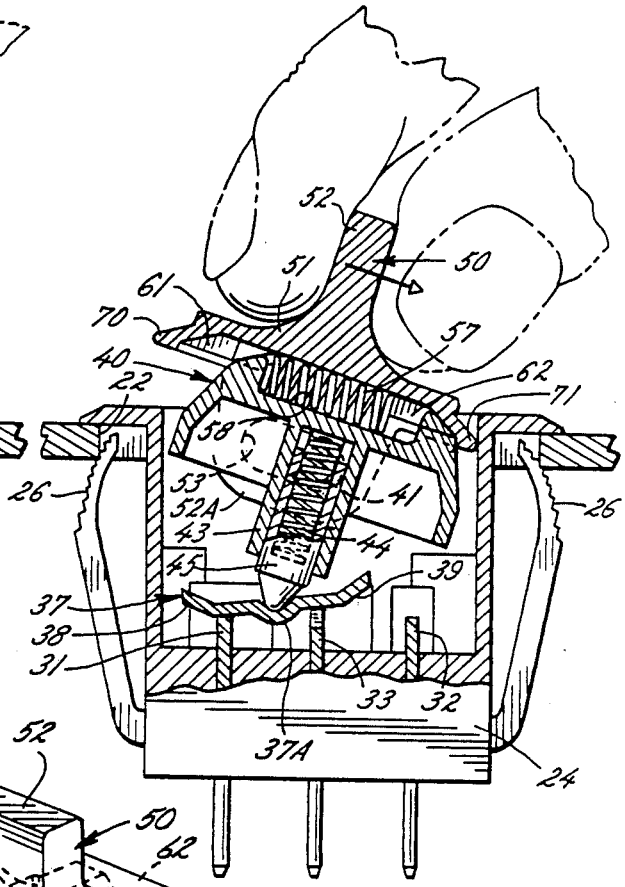
Figure 7:
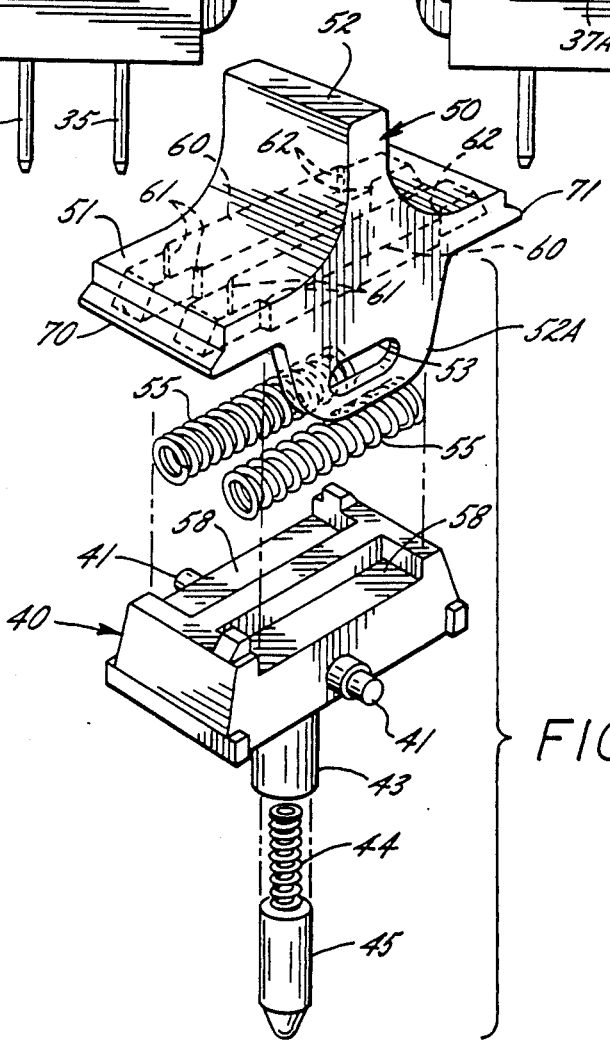
FIG. 7 is an exploded perspective view of certain components of the switch.

Sliding and pivoting of the contactor arm 37 is effected by a rocker-type actuator 40 which is supported by the cup 24 to pivot counterclockwise from a neutral position (FIG. 2) to a first actuated position (FIG. 4) and to pivot clockwise from the neutral position to a second actuated position (FIG. 6). Herein, the rocker 40 is molded of plastic and is formed with two oppositely extending pins 41 (FIG. 7) which project through circular holes in the cup 24 to support the rocker for pivoting about a horizontal axis. The rocker is formed with a generally vertical sleeve 43 which houses a spring 44 and a plunger 45, the spring biasing the plunger downwardly against the contactor arm 37. When the rocker 40 is located in its neutral position as shown in FIG. 2, the spring presses the plunger downwardly into the dimple 37A in the central portion of the arm 37 and holds the arm in a horizontal position on the contact 33 so as to keep the contacts 38 and 39 out of engagement with the contacts 31 and 32.

When the rocker 40 is pivoted counterclockwise about the axis of the pins 41 from the neutral position shown in FIG. 2 to the actuated position shown in FIG. 4, the plunger 45 shifts the arm 37 to the right and causes the arm to pivot clockwise about the contact 33 so as to press the contact 39 downwardly against the contacts 32. On the other hand, clockwise pivoting of the rocker 40 from the neutral position of FIG. 2 to the actuated position of FIG. 6 causes the plunger 45 to pivot the arm 37 counterclockwise about the contact 33 and to press the contact 38 downwardly against the contact 31. In each of the actuated positions of the rocker, the spring 44 tends to pivot the rocker back to its neutral position.

In accordance with the present invention, the three-position switch 20 is provided with a relatively simple and inexpensive latch 50 which prevents the switch rocker 40 from being actuated to either of its switch-closed states unless two separate and distinct motions are applied to the switch. The latch releasably holds the rocker in each of its switch-closed states and enables the switch to be de-actuated or opened from either of its closed states with a simple single motion. Thus, the switch 20 is truly a safety switch in that a conscious effort involving separate motions is required for actuation so as to prevent accidental closing of the switch and yet, at the same time, the switch may be quickly opened under an emergency condition and may be opened easily under normal conditions.

Figure 5:
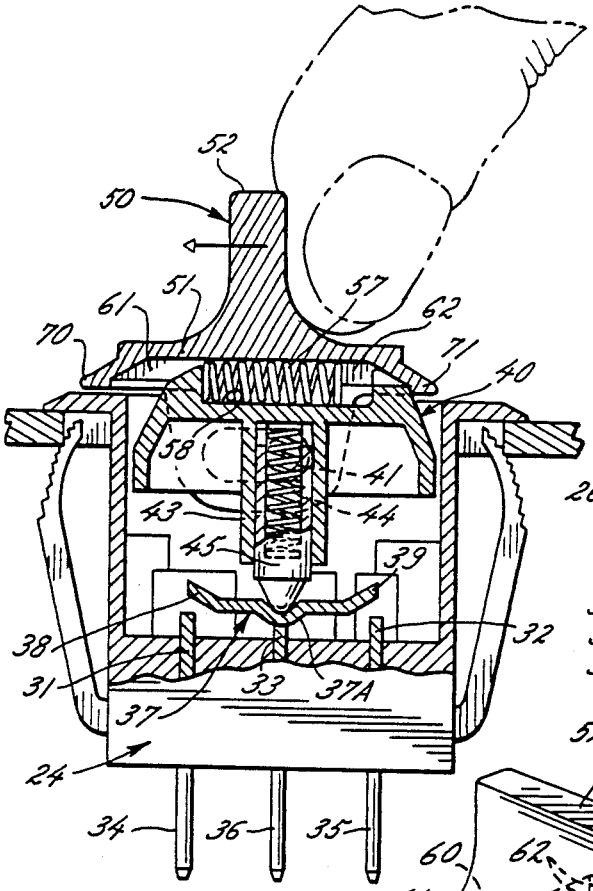
FIGS. 5 and 6 also are views generally similar to FIG. 2 but show certain components of the switch being successively moved to place the switch in its second actuated state.

More specifically, the latch 50 includes a plate 51 molded of plastic and formed with a central and upwardly projecting handle 52. The plate overlies the upper end of the rocker 40. Formed integrally with and depending from the plate are two laterally spaced ears 52A (FIGS. 2 and 7) which straddle the rocker 40. Each ear is formed with an elongated and generally horizontal slot 53 which receives the adjacent pin 41 with a sliding fit. The pins and slots mount the latch 50 for back and forth sliding on the rocker 40 from a centered latched position (FIG. 2) to a rightwardly located first unlatched position (FIG. 3) and from the centered position to a leftwardly located second unlatched position (FIG. 5).

The latch 50 is biased to and is normally held in its centered latched position by a pair of coiled compression springs 55. As shown most clearly in FIG. 7, the springs are received in two side-by-side and upwardly opening pockets 58 formed in the upper side of the rocker 40. In addition, the springs are received in two aligned pockets 60 formed in and opening downwardly out of the lower side of the plate 51 of the latch 50. The ends of the springs normally engage the ends of the pockets 58 and normally engage left and right abutments 61 and 62 formed adjacent the left and right ends, respectively, of the pockets 60. As a result of such engagement, the springs 57 normally hold the latch 50 in its latched position and keep the latch centered with respect to the cup 24 and the rocker 40.

When the rocker 40 is in its neutral position and the latch 50 is in its centered latched position (FIG. 2), left and right noses 70 and 71 defined at the left and right ends, respectively, of the latch plate 51 overlie the flange 25 of the cup 24. As a result, the nose 70 engages the flange 25 to prevent the rocker 40 from being pivoted counterclockwise to its first actuated position while the nose 71 engages the flange to prevent the rocker from being pivoted clockwise to its second actuated position. Accordingly, it is not possible to pivot the actuator in either direction by merely applying a simple pivoting force to the handle 52 of the latch 50.

Figure 3:
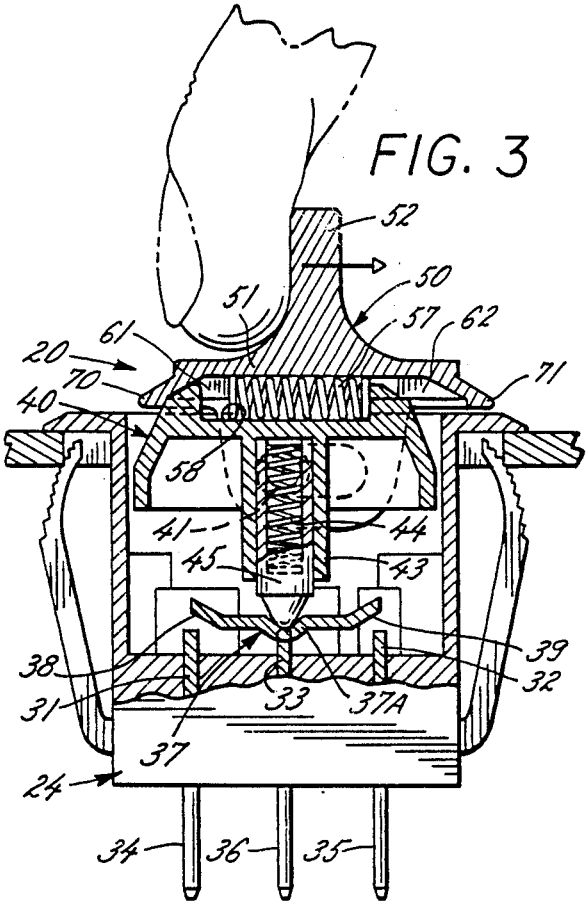
FIGS. 3 and 4 are views generally similar to FIG. 2 but show certain components of the switch being successively moved to place the switch in its first actuated state.

To move the rocker 40 to its first actuated position and close the contacts 32 and 39, the handle 52 of the latch 50 is engaged by a forefinger or is gripped between a thumb and a forefinger and is slid to the right to its first unlatched position as permitted by the pins 41 and the slots 53 (see FIG. 3). During such sliding, the left abutments 61 in the pockets 60 engage the springs 57 and compress the springs against the right end walls of the pockets 58. Once the nose 70 of the latch has been shifted to the right to a position clearing the flange 25 of the cup 24, the handle 52 may be swung counterclockwise as shown in FIG. 4 to enable the rocker 40 to pivot to a position closing the contacts 32 and 39. When the handle is released, the springs 57 snap the latch 50 to the left and cause the nose 70 thereof to bear against and frictionally engage the inner wall of the cup 24. Such frictional engagement holds the rocker 40 in its actuated position against the action of the spring 44 and thus the contacts 32 and 39 are held in their closed state.

Movement of the rocker from its neutral position of FIG. 2 to its actuated position of FIG. 6 is accomplished in a similar but reverse manner. Thus, the latch 50 first is pushed to the left as shown in FIG. 5 to cause the abutments 62 to load the springs 57 and to shift the nose 71 clear of the flange 25. Thereafter, the rocker 40 is pivoted clockwise to the position shown in FIG. 6 and, when the handle 52 is released, the nose 71 snaps into frictional engagement with the inner wall of the cup 24 in order to hold the rocker releasably in its actuated position.

The rocker 40 may be returned from either of its actuated positions simply by gripping the handle 52 and pivoting the handle in the appropriate direction. This overcomes the frictional resistance of the nose 70, 71 against the cup 24 and allows the rocker to return to its neutral position. Once the nose 70, 71 has moved out of the cup 24, the springs 57 automatically slide the latch 50 to its latched position. Thus, only a simple single motion is required to de-actuate the switch 20.

Figure 8:
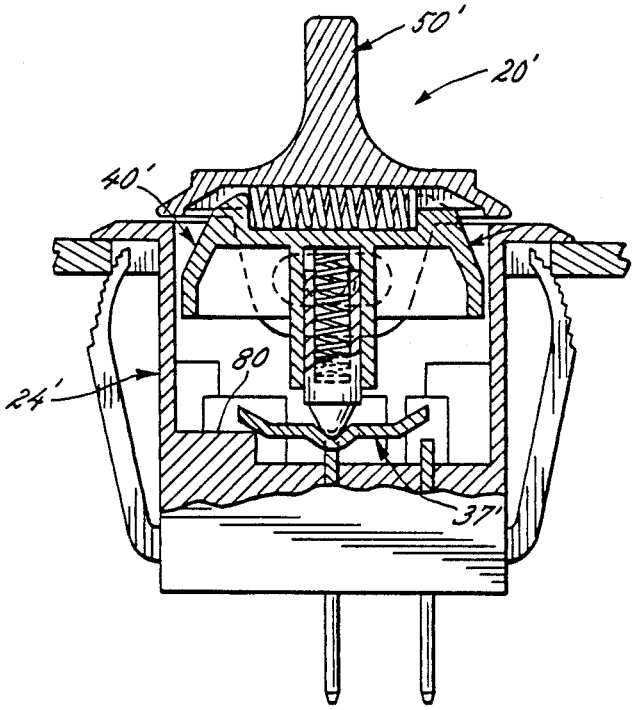
FIGS. 8, 9 and 10 are views corresponding generally to FIGS. 2, 3 and 4, respectively, but show a modified version of the switch.
Figure 9:
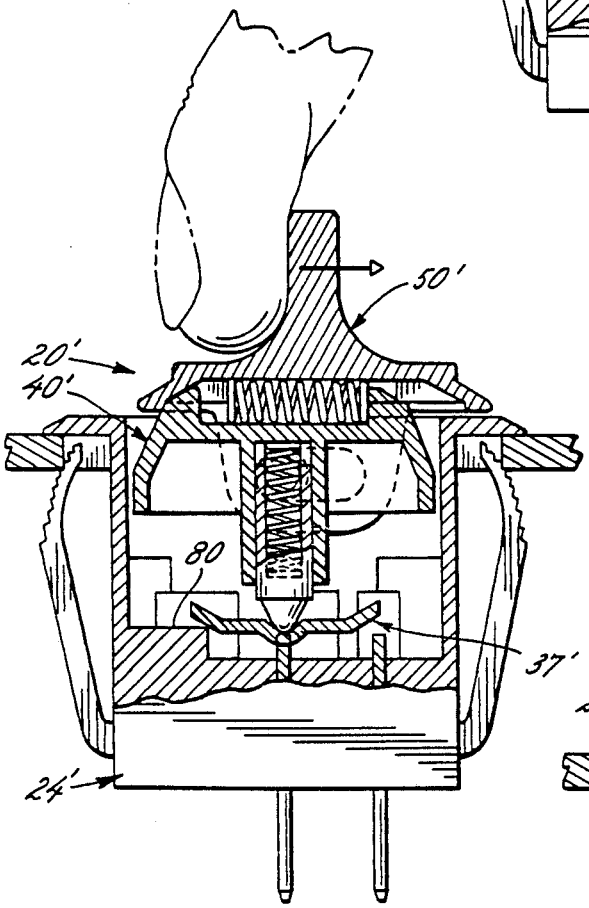
Figure 10:
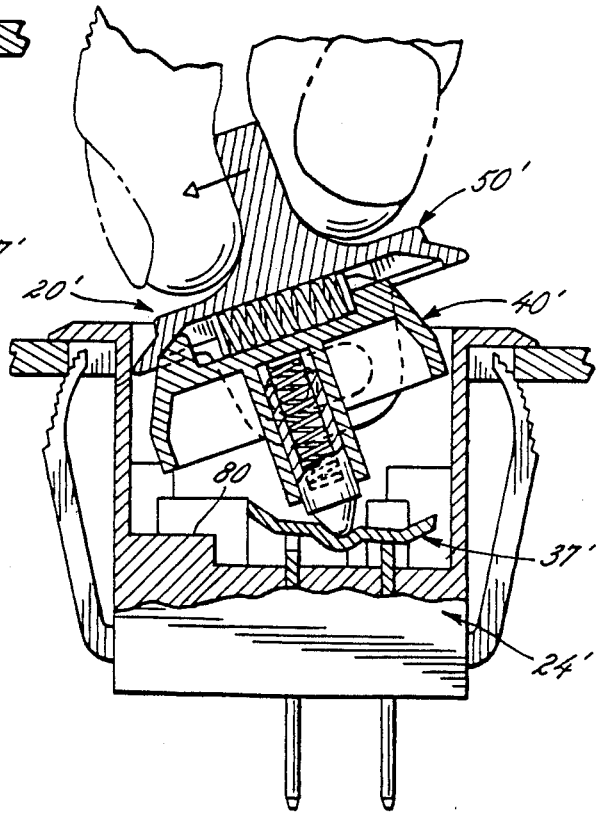

A slightly modified switch 20' has been shown in FIGS. 8 to 10 and is a simple two-position on-off switch. The "off" position has been shown in FIG. 8 while FIG. 10 shows the "on" position. FIG. 9 shows the latch 50' being shifted to its unlatched position preparatory to the rocker 40' being pivoted to the actuated position of FIG. 10.

The switch 20' and the switch 20 are identical except that the switch 20' does not include a contact and terminal similar to the contact 31 and the terminal 34 of the switch 20. Instead, the inside of the cup 24' of the switch 20' is formed with a raised ledge 80 which supports the contactor arm 37' when the rocker 40' is in its "off" position shown in FIG. 8.

We claim:

1. A safety switch comprising a body having a pair of spaced switch contacts each movable between first and second states, each of said contacts normally being disposed in said first state, a manually movable switch actuator having a neutral position in which said actuator leaves each of said contacts in said first state, said actuator being movable in one direction from said neutral position to a first actuated position in which the actuator changes one of said contacts from said first state to said second state, said actuator being movable in the opposite direction from said neutral position to a second actuated position in which the actuator changes the other of said contacts from said first state to said second state, a latch mounted on said actuator, said latch being movable with said actuator between said positions, said latch being movable in one direction relative to said actuator between a centered latched position and a first unlatched position and being movable in the opposite direction relative to said actuator from said latched position to a second unlatched position, means biasing said latch toward said latched position and away from each of said unlatched positions, said latch being positively engageable with said body when said latch is in said latched position and said actuator is in said neutral position and acting to prevent movement of said actuator from said neutral position to either of said first and second actuated positions, and said latch being operable when in said first unlatched position to permit movement of said actuator from said neutral position to said first actuated position and being operable when in said second unlatched position to permit movement of said actuator from said neutral position to said second actuated position.

2. A safety switch as defined in claim 1 in which said biasing means press said latch into frictional engagement with said body both when said actuator is in said first actuated position and when said actuator is in said second actuated position thereby to releasably maintain said actuator in each of said actuated positions.

3. A safety switch as defined in claim 2 in which said biasing means comprise a coiled compression spring having first and second opposite ends, first and second opposing pockets formed in said latch and said actuator, respectively, and receiving said spring, means in said first pocket in engagement with the first end of said spring and pressing said spring against said second pocket when said latch is in said first unlatched position, and means in said first pocket in engagement with the second end of said spring and pressing said spring against said second pocket when said latch is in said second unlatched position.

* * * * *